US007182625B2

(12) United States Patent
Machado et al.

(10) Patent No.: US 7,182,625 B2
(45) Date of Patent: Feb. 27, 2007

(54) GROUNDING CONNECTOR

(75) Inventors: Manuel H Machado, Hope, RI (US); Jonathan D. Young, Worthington, OH (US)

(73) Assignee: Antaya Technologies Corporation, Cranston, RI (US)

( * ) Notice: Subject to any disclaimer, the term of this patent is extended or adjusted under 35 U.S.C. 154(b) by 0 days.

(21) Appl. No.: 11/004,351

(22) Filed: Dec. 3, 2004

(65) Prior Publication Data

US 2006/0121771 A1 Jun. 8, 2006

(51) Int. Cl.
*H01R 11/20* (2006.01)

(52) U.S. Cl. ..... 439/395; 439/98

(58) Field of Classification Search ..... 439/395, 439/441, 806, 98, 398, 402, 423–424; 174/68.1, 174/68.3, 72 A, 135, 84 C
See application file for complete search history.

(56) References Cited

U.S. PATENT DOCUMENTS 2,680,235 A 6/1954 Pierce
2,841,026 A 7/1958 Glass
3,058,088 A 10/1962 Miller
3,546,365 A 12/1970 Collier
3,568,128 A 3/1971 Taylor
3,728,665 A 4/1973 Frey
3,828,298 A 8/1974 Schumacher
4,029,384 A 6/1977 Reinwall, Jr. et al.
4,304,454 A 12/1981 Yokota
4,325,598 A 4/1982 Leonardo
4,455,057 A 6/1984 Mariani
4,461,527 A 7/1984 Izraeli
5,083,937 A * 1/1992 Bogiel et al. ..... 439/441
5,864,090 A 1/1999 Wright
6,297,447 B1 10/2001 Burnett et al.
6,737,585 B2 * 5/2004 Aoyama et al. ..... 174/68.1

* cited by examiner

*Primary Examiner*—Truc T. Nguyen
*Assistant Examiner*—Edwin A. Leon
(74) *Attorney, Agent, or Firm*—Hamilton, Brook, Smith & Reynolds, PC

(57) ABSTRACT

A grounding connector includes a base with a first crimping structure extending from the base for crimping to the cable and securing the cable relative to the base along a cable axis. A first contact member can extend from the base laterally adjacent to the first crimping structure. The first contact member can have a narrowing first cable slot for receiving the cable to engage and form electrical contact with the cable when the first crimping structure is crimped to the cable.

24 Claims, 7 Drawing Sheets

GROUNDING CONNECTOR

BACKGROUND

Electrical cable assemblies that are connected to electrical devices can sometimes require electrical grounding to provide desired or suitable results. Such grounding can be accomplished by electrically connecting a conductor in the cable of the assembly to a connector terminal that is, in turn, connected to ground. One method of making the electrical connection is to strip the outer insulation from the cable for exposing the conductor, which is then secured to the connector terminal. Another method includes securing a connector terminal to the cable which has pointed protrusions for piercing through the insulation and the conductor of the cable in order to form the electrical connection with the conductor.

SUMMARY

The present invention provides a grounding connector for a cable which can electrically ground a cable in a quick and easy manner. The grounding connector can include a base with a first crimping structure extending from the base for crimping to the cable and securing the cable relative to the base along a cable axis. A first contact member can extend from the base laterally adjacent to the first crimping structure. The first contact member can have a narrowing first cable slot for receiving the cable to engage and form electrical contact with the cable when the first crimping structure is crimped to the cable.

In particular embodiments, the connector can be formed from electrically conductive sheet material. The cable can have an outer layer of insulation where the first cable slot is capable of receiving the cable and can cut through the outer layer of insulation for forming electrical contact with the cable. The first cable slot can have a bevelled cutting edge and can terminate in a radiused slot end. The connector can further include a second crimping structure extending from the base for crimping to the cable and securing the cable relative to the base along the cable axis. The first and second crimping structures can each include a pair of crimping tabs. A second contact member can extend from the base laterally adjacent to the second crimping structure. The second contact member can have a narrowing cable slot for receiving the cable to engage and form electrical contact with the cable when the second crimping structure is crimped to the cable. The second cable slot is capable of cutting through the outer layer of insulation for forming electrical contact with the cable. The second cable slot can have a bevelled cutting edge and terminate in a radiused slot end. The first and second cable slots can be sized for forming electrical contact with an outer conductor of a coaxial cable. The first and second contact members can be bent from the base away from the cable axis, then back towards and across the cable axis for aligning the cable axis with desired portions of the first and second cable slots.

A grounding member can extend from the base for electrical connection to a grounding surface and can include a fastener portion for securement to the grounding surface. In particular embodiments, the grounding member can include an opening through which a stud can be inserted for securing the grounding member to the grounding surface. In one embodiment, a plastic push stud can be extended through the opening in the grounding member to secure the grounding member to the grounding surface. In another embodiment, the opening in the grounding member can include self locking features for locking to a grounding stud protruding from the grounding surface. In still other embodiments, the grounding member can include a resilient conductive clip portion for resiliently clipping to the grounding surface with opposed legs. The conductive clip portion can be a separate piece that is secured to the connector. Various embodiments of the connector can provide grounding for the cable and serve as a retaining clip.

The present invention additionally provides a coaxial cable assembly including a length of coaxial cable having proximal and distal electrical connectors. The coaxial cable has an outer layer of insulation and inner and outer conductors. A grounding connector can be secured to the cable at a location between the electrical connectors for grounding the cable. The grounding connector can include a base with a first crimping structure extending from the base that is crimped to the cable and secures the cable relative to the base along a cable axis. A first contact member can extend from the base laterally adjacent to the first crimping structure. The first contact member receives the cable in a narrowing first cable slot which engages and forms electrical contact with the cable. The first cable slot can cut through the outer layer of insulation for forming electrical contact with the outer conductor of the cable.

The grounding connector of the assembly can further include a grounding member extending from the base for electrical connection to a grounding surface. The grounding member can have a fastener portion for securement to the grounding surface. At least one non-grounding retaining clip can be secured to the cable for further securing the assembly during installation. The grounding connector can be positioned within about 20 inches away from the distal electrical connector and can further include features of the grounding connector previously described. The grounding connector can provide grounding for the cable and serve as a retaining clip for securing the assembly during installation. In particular embodiments, the grounding member can include an opening through which a stud can be inserted for securing the grounding member to the grounding surface. In one embodiment, a plastic push stud can be extended through the opening in the grounding member to secure the grounding member to the grounding surface. In another embodiment, the opening in the grounding member can include self locking features for locking to a grounding stud protruding from the grounding surface. In still other embodiments, the grounding member can include a resilient conductive clip portion for resiliently clipping to the grounding surface with opposed legs. The conductive clip portion can be a separate piece that is secured to the connector.

The present invention further provides a coaxial cable assembly including a length of coaxial cable having proximal and distal electrical connectors. The coaxial cable has an outer layer of insulation and inner and outer conductors. A grounding connector can be secured to the cable within about 20 inches away from the distal electrical connector. In some embodiments, the grounding connector can be positioned within about 5 to 15 inches away from the distal connector.

The present invention also provides a method of grounding a coaxial assembly, where the assembly includes a length of coaxial cable, and proximal and distal electrical connectors located on opposite ends. The coaxial cable has an outer layer of insulation and inner and outer conductors. A grounding connector can be secured to the cable within about 20 inches away from the distal electrical connector. In some embodiments, the grounding connector can be positioned within about 5 to 15 inches away from the distal electrical connector.

The present invention also provides another method of grounding a coaxial cable assembly. The assembly includes a length of coaxial cable, and proximal and distal electrical connectors located on opposite ends. The coaxial cable has an outer layer of insulation and inner and outer conductors. A grounding connector is secured to the cable at a location between the electrical connectors for grounding the cable. The grounding connector can include a base with a first crimping structure extending from the base that is crimped to the cable and secures the cable relative to the base along a cable axis. A first contact member can extend from the base laterally adjacent to the first crimping structure. The first contact member can receive the cable in a narrowing first cable slot which engages and forms electrical contact with the cable. The first cable slot can cut through the outer layer of insulation for forming electrical contact with the outer conductor of the cable.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
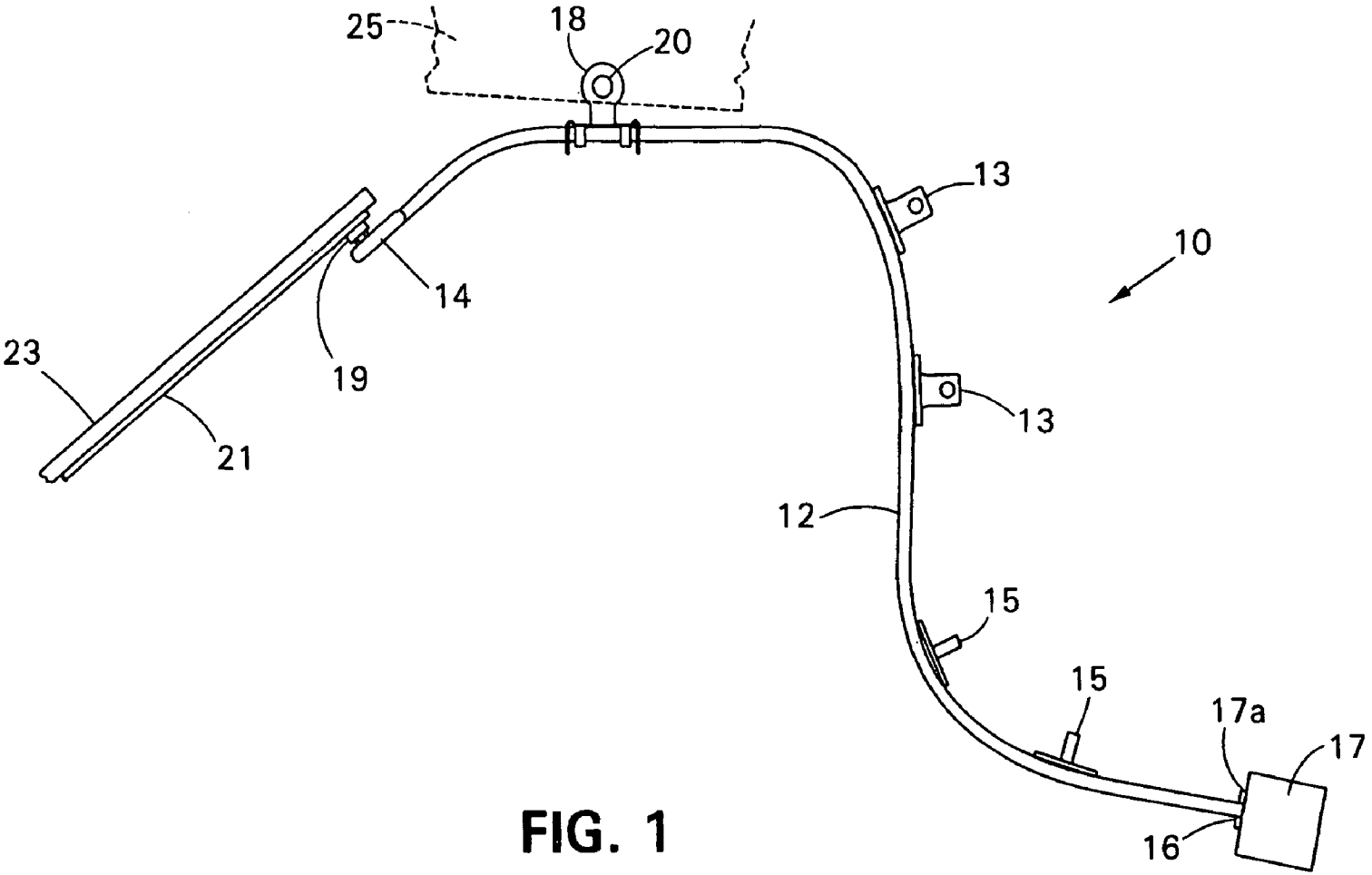
FIG. 1 is a schematic drawing of a coaxial cable assembly in the present invention connected between two devices.
Figure 2:
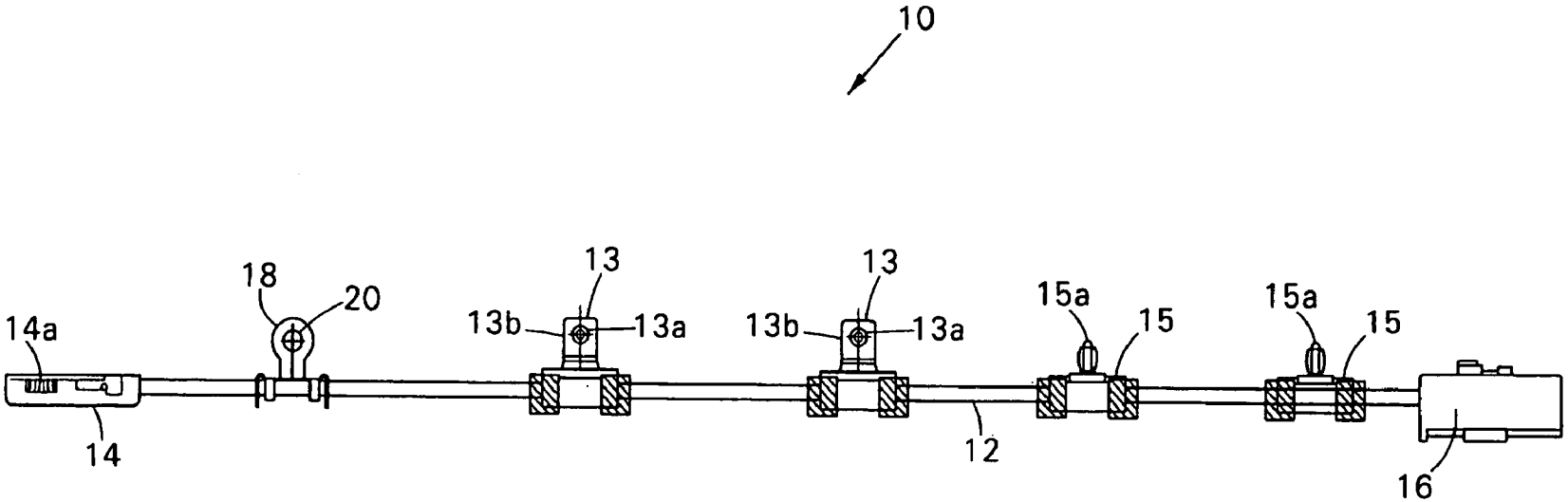
FIG. 2 is a side view of the coaxial cable assembly of FIG. 1.

Referring to FIGS. 1 and 2, cable assembly 10 provides an electrical connection between a first device 21, for example an antenna, which can be on the glass 23 of a windshield or a rear window of a motorized vehicle, and a second device 17, for example a receiver, which can be associated with an automatic engine starter, automatic door locks, or radio of the motorized vehicle. In the embodiment depicted, the cable assembly 10 includes a length of coaxial cable 12 having an outer layer of insulation 35 (FIG. 6) and inner 39 and outer 37 conductors. The cable assembly 10 can have proximal 16 and distal 14 end electrical connectors secured at opposite ends of the cable 12 as shown, or at spaced-apart locations. The proximal connector 16 engages a mating connector 17*a* of device 17 and the distal connector 14 engages a mating connector 19 of device 21. A grounding connector 18 is secured to the cable 12 near the distal connector 14 and is electrically connected to the outer conductor 37 (FIG. 6) of the cable 12 for grounding the outer conductor 37 of the cable 12 near the distal connector 14 and device 21. The grounding connector 18 can be connected to a grounding surface 25 by a stud 20 to provide a permanent and secure mechanical or physical connection for providing a constant or positive ground connection. By grounding the outer conductor 37 of the cable 12 near the distal connector 14, the operation of device 17 can be improved, for example, the distance at which an automatic engine starter can be remotely operated, can be greatly increased. The cable assembly 10 can also include one or more non-grounding retaining clips 13 and/or 15 which are attached to the cable 12 at desired locations along the length of the cable 12 for securing the cable assembly 10 in a desired position or orientation relative to mounting surfaces. The grounding connector 18 can also serve as a retaining clip for aiding in the securement of the cable assembly 10.

A more detailed description of the cable assembly 10 and grounding connector 18 now follows. In the embodiment shown in FIGS. 1 and 2, the proximal connector 16 engages the mating connector 17*a* of device 17 in longitudinal alignment with the longitudinal axis of the cable 12. The distal connector 14 engages the mating connector 19 at a right angle relative to the longitudinal axis of the cable 12. The distal connector 14 can have a circular female socket 14*a* (FIG. 2). In such a case, the mating connector 19 is a circular male connector which engages the female socket 14*a* at a right angle to the longitudinal axis of the cable 12. In one embodiment, the distal connector 14 can be similar to connectors described in U.S. Pat. No. 6,520,812, and the mating connector 19 can be similar to connectors described in U.S. Pat. No. 6,475,043, the contents of both are incorporated herein by reference in their entirety. In other embodiments, the proximal 16 and distal 14 connectors can be of other suitable configurations and engage mating connectors at other angles relative to the longitudinal axis of the cable 12. For example, both connectors can be in longitudinal alignment with the cable 12 or at right angles to the cable 12, or the proximal connector 16 can engage at a right angle and distal connector 14 can engage in alignment with the longitudinal axis of the cable 12. Furthermore, engagement can be made at intermediate angles.

The retaining clips 13 and 15 can be plastic clips which are secured to the cable 12, for example by tape, securement bands, adhesives, clamping arrangements, or other suitable methods of fastening. The retaining clips 13 and 15 can each include a fastener protrusion 13*a* and 15*a* for insertion into a mating hole for securing the cable assembly 10 to a mounting surface. The retaining clips 13 can have an arm 13*b* that is bent at a right angle from which the fastener protrusion 13*a* extends offset from the cable 12. On the other hand, the retaining clips 15 can have a fastener protrusion 15*a* that extends directly outwardly from the cable 12. Although two retaining clips 13 and two retaining clips 15 are shown attached to the cable assembly 10, it is understood that various combinations and number of clips 13 and 15 can be employed on the cable assembly 10. In addition, retaining clips of other configurations can be employed or included. Alternatively, retaining clips can be omitted from the cable assembly 10.

Figure 3:
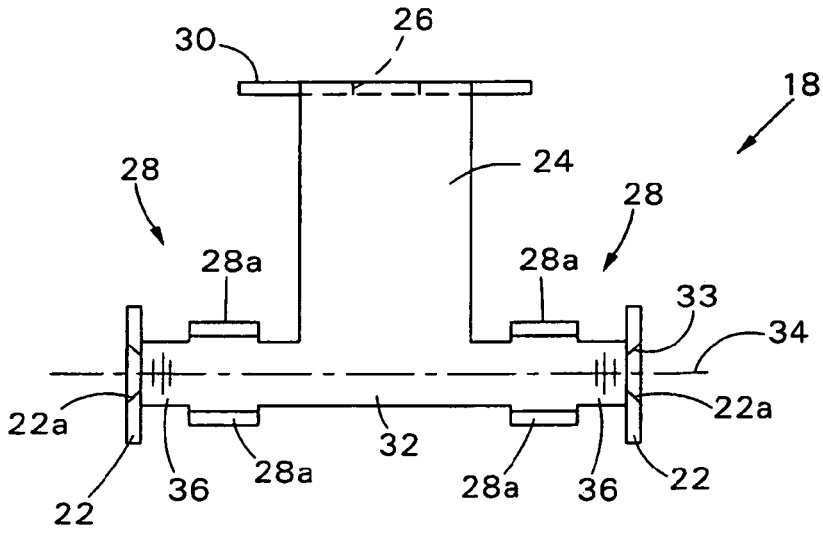
FIG. 3 is a top view of a grounding connector in the present invention.
Figure 4:
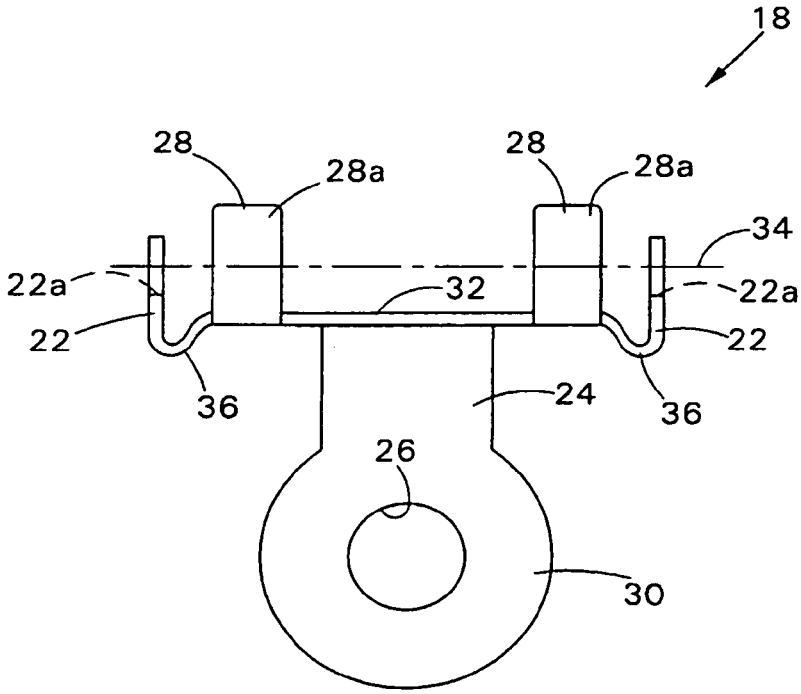
FIG. 4 is a side view of the grounding connector of FIG. 3.
Figure 5:
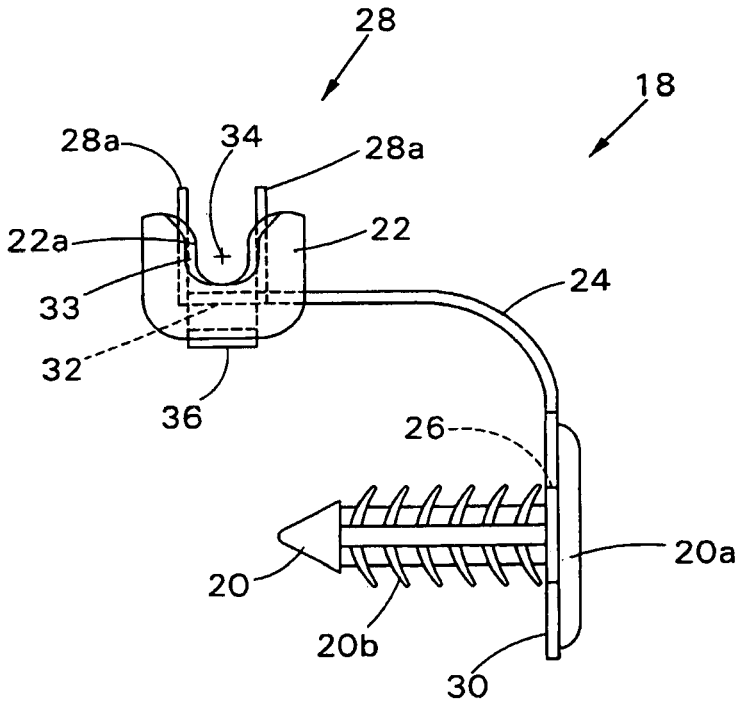
FIG. 5 is an end view of the grounding connector of FIG. 3.

The grounding connector 18 is often close to the distal connector 14 for optimum results, for example, within 20 inches, often between about 5 and 15 inches, and in one embodiment, is about 7½ inches away. In some embodiments, the distance can be greater than 20 inches. Referring to FIGS. 3–5, the ground connector 18, in one embodiment, includes a base 32 with two securement arrangements or crimping structures 28 extending from the base 32 which are spaced apart from each other along the length of the base 32. The crimping structures 28 can each include two deformable crimping tabs 28*a* which are bent from the base 32 from opposite sides. The crimping tabs 28*a* of each crimping structure 28 can be crimped to the cable 12 to secure the cable 12 to the grounding connector 18 along a cable receiving axis 34. Two contact members 22 can extend from and be bent from opposite ends of the base 32 so that each contact member 22 is laterally adjacent to a crimping structure 28 in the longitudinal direction of the cable axis 34. Each contact member 22 can be bent to intersect or extend across the cable axis 34. In the embodiment shown in FIGS. 3 and 4, the contact members 22 intersect the cable axis 34 at a right angle, however, alternatively, can be at other suitable angles. The contact members 22 can be bent from the base 32 away from the cable axis 34 and then back towards and across the cable axis 34 for aligning the cable axis 34 in the proper position relative to cable slots 22*a* extending within the contact members 22. This forms bent regions 36 which extend away from the cable axis 34 between the crimping structures 28 and the contact members 22. The distance between the crimping structures 28 and the contact members 22 can be adjusted by the angle and location of the bends of the bent regions 36. Although the base 32 is shown to be generally planar, the base 32 can be bent or have bent regions if desired.

Figure 6:
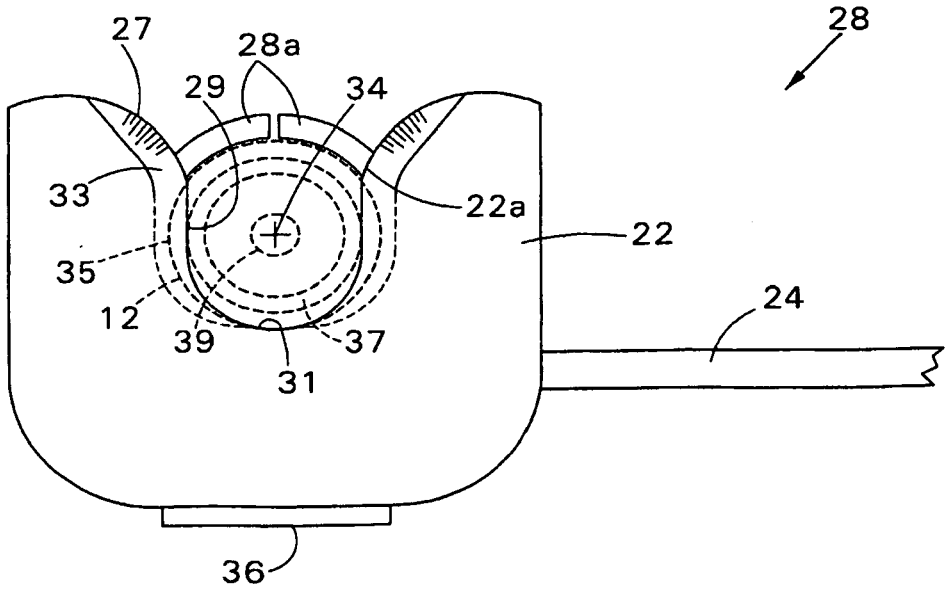
FIG. 6 is an enlarged end view of a portion of the grounding connector of FIG. 3 which is crimped to a cable.

When the cable 12 is crimped to the grounding connector 18 with the crimping structures 28, the cable 12 is forced or driven into the cable slots 22*a* of the adjacent contact members 22 by the forces generated in the crimping operation. Although crimping is the method shown in the figures for securing the ground connector 18 to the cable 12, other methods of securement can be employed, for example, tape, securement bands, clamping arrangements, clips, etc. Referring to FIG. 6, the cable slots 22*a* are sized and shaped to cut or slice through the outer layer of insulation 35 of the cable 12 to come into mechanical or physical contact, and therefore, electrical contact with the outer conductor 37. Each cable slot 22*a* has a narrowing entrance 27 which joins a mid-section portion 29 and terminates in a radiused slot end 31. The entrance 27 can be curved in a convex manner such as shown, so that when the cable 12 enters the entrance 27, the area of contact between the cable 12 and the surfaces of the entrance 27 is minimized for maximizing the cutting force of the entrance 27. The cable slot 22*a* can also have a bevelled or chamfered cutting edge 33 to provide a sharper cutting edge if necessary. As the cable 12 is further forced through each cable slot 22*a*, the mid-section portion 29 of the cable slot 22*a* comes into contact with the outer conductor 37 of the cable 12. Depending upon the relative dimensions, the outer conductor 37 can be pinched slightly within the mid-section portion 29. The radiused slot end 31 prevents any further travel of the cable 12 through the cable slot 22*a* so that the cable 12 can be secured to the grounding connector 18 generally along the cable receiving axis 34. Having a radiused slot end 31 can allow the cable slot 22*a* to be shorter in length than if the cable slot 22*a* merely angled to a sharp point or vee and distributes stresses over the curved length of the radiused slot end 31 rather than at a single point, which would occur if the cable slot 22*a* came to a sharp point or vee. This provides increased strength for the contact member 22 so that the sides of the contact member 22 and cable slot 22*a* resist spreading apart under the pressure of the cable 12 when the cable 12 is forced into the cable slot 22*a*.

A grounding member or arm 24 of the grounding connector 18 can extend from the base 32 at a location between the crimping structures 28. The grounding arm 24 can have a securement portion 30 with an opening or hole 26 which allows securement to the grounding surface 25 for electrically grounding the cable assembly 10. Referring to FIG. 5, a plastic fastener 20 such as a push stud can be inserted through the hole 26 until the head 20*a* of the fastener abuts the securement portion 30. The fastener 20 can have a series of deflectable fins 20*b* for engaging and locking within a hole in the grounding surface 25 which presses the securement portion 30 against the grounding surface 25 for electrically connecting the grounding arm 24 to the grounding surface 25. Alternatively, the fastener 20 can extend from a hole in the grounding surface 25 for engagement with the hole 26 in the securement portion 30. In other embodiments, screws or bolts can be inserted through hole 26 for the securing the grounding arm 28 to the grounding surface 25. In addition, the grounding arm 24 can be secured to a threaded stud extending from the grounding surface 25 by a threaded nut or other locking device. In some embodiments, the stud and locking device do not have to be threaded.

The grounding arm 24 can be shaped or bent to retain the grounding connector 18 and cable assembly 10 in a desired position or orientation relative to the grounding surface 25, also serving as a retaining clip. Referring to FIG. 5, the grounding arm 24 is shown bent so that the securement portion 30 is at a right angle to the plane of the base 32. Depending upon the configuration and orientation of the grounding surface 25, the grounding arm 24 can be bent into a variety of suitable configurations, or even can remain unbent. In addition, the grounding arm 24 can be replaced with a flexible conductor such as a wire for electrically connecting the base 32 of the grounding connector 18 with the grounding surface 25.

In one embodiment, the grounding connector 18 can be made of electrically conductive material, for example, sheet metal about 0.03 inches thick, such as C210, ½ hard copper alloy, having about 95% copper and 5% zinc. If desired, the grounding connector can be plated or painted a particular desired color. The distance between the crimping structures 28 can be about 0.625 inches, with the crimping tabs 28*a* in each crimping structure 28 being about 0.16 inches wide, about 0.3 inches high, and about 0.2 inches apart from each other. The contact members 22 can be about 1.25 inches apart from each other and can be spaced from the adjacent crimping structures 28 by about 0.13 inches. The contact members 22 can be about 0.38 inches wide and about 0.3 inches high, with the cable slots 22*a* being about 0.18 inches long. The cable slots 22*a* can be about 0.12 inches wide at the mid-section portion 29, with the radiused slot end 31 having a radius of about 0.06 inches. The narrowing entrance 27 progressively narrows and can have convexly curved surfaces on opposite sides of the cable slot 22*a* with radiuses of about 0.08 inches. The bevelled cutting edge 33 can be a chamfer that is about 0.04 inches by 10°. The chamfer can vary in size and angle depending upon the thickness of the sheet metal. In addition, the cutting edge 33 can have a curved profile instead of angled. The cable slot 22*a* can come into electrical contact with the outer conductor 37 of the cable 12 without piercing the outer conductor 37. Alternatively, in some embodiments, the cable slot 22*a* can be configured, or include protrusions, to provide piercing. The grounding arm 24 can be bent so that the securement portion 30 is about 0.7 inches away from the side edge of the base 32 and about 0.9 inches away from the plane of the base 32. The securement portion 30 can have a curved perimeter with a diameter of about 0.72 inches and the hole 26 can be about 0.29 inches in diameter. It is understood that the dimensions for the ground connector 18 will vary depending upon the size and configuration of the cable 12 as well as the grounding surface 25.

Figure 7:
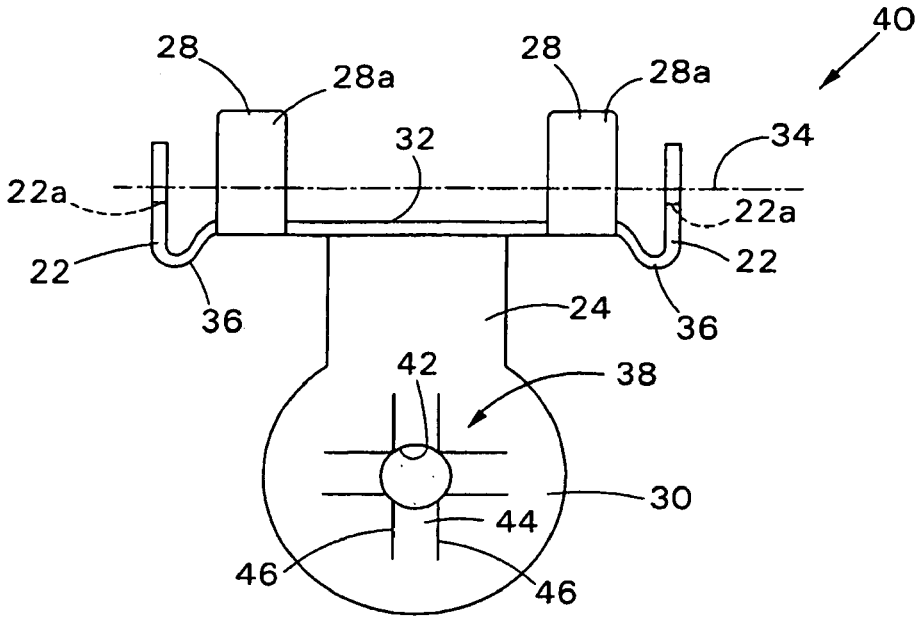
FIG. 7 is a side view of another embodiment of a grounding connector in the present invention.
Figure 8:
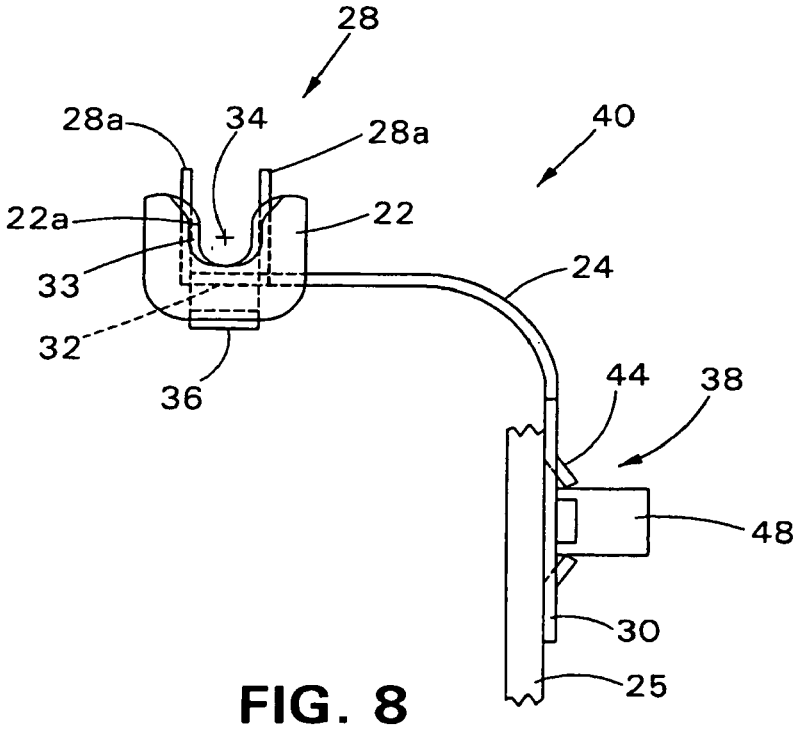
FIG. 8 is an end view of the grounding connector of FIG. 7 secured to a grounding stud of a grounding surface.

Referring to FIG. 7, grounding connector 40 is another grounding connector in the present invention which differs from grounding connector 18 in that the securement portion 30 includes an integrally formed locking mechanism 38 with self locking features for engaging and locking to a stud 48 extending from the grounding surface 25, such as seen in FIG. 8. The locking mechanism 38 can have a central opening 42 that is smaller than the diameter of the stud 48, and which is surrounded by a series of deflectable locking tabs 44 defined by slots 46. When securing the grounding arm 24 of the ground connector 40 to the grounding surface 25, the opening 42 is aligned with and pushed onto the stud 48. As the securement portion 30 is pushed onto the stud 48, the locking tabs 44 can be deflected so that the tips of the locking tabs 44 engage and lock onto the surfaces of the stud 48. The securement portion 30 can be pushed to the base of the stud 48 into electrical contact with the grounding surface 25. Electrical contact between the grounding connector 40 and the grounding surface 25 can be also be provided between the locking tabs 44 and the stud 48.

Figure 9:
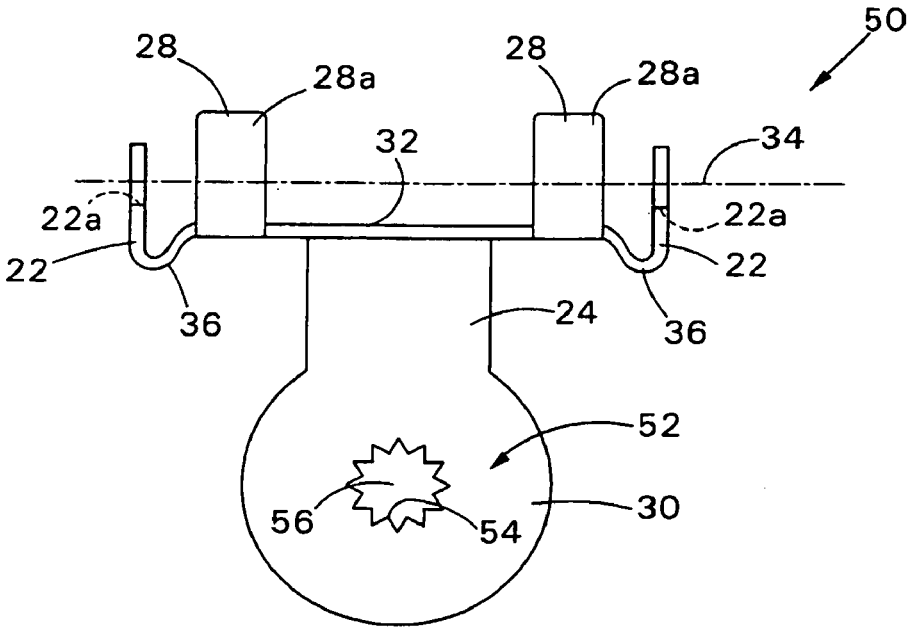
FIG. 9 is a side view of yet another embodiment of a grounding connector in the present invention.

Referring to FIG. 9, grounding connector 50 is yet another grounding connector in the present invention which differs from grounding connector 40 in that grounding connector 50 has a locking mechanism 52 with self locking features including an opening 56 surrounded by a series of pointed protrusions 54. When the opening 56 of the securement portion 30 is aligned with and pushed over the stud 48, the pointed protrusions 54 can deflect to allow the securement portion 30 to be slid onto the stud 48. The points of the protrusions 54 can engage the surfaces of the stud 48 to provide locking. The number and size of the protrusions 54 of grounding connector 50 can vary, depending upon the application at hand, as with the locking tabs 44 of grounding connector 40.

Figure 10:
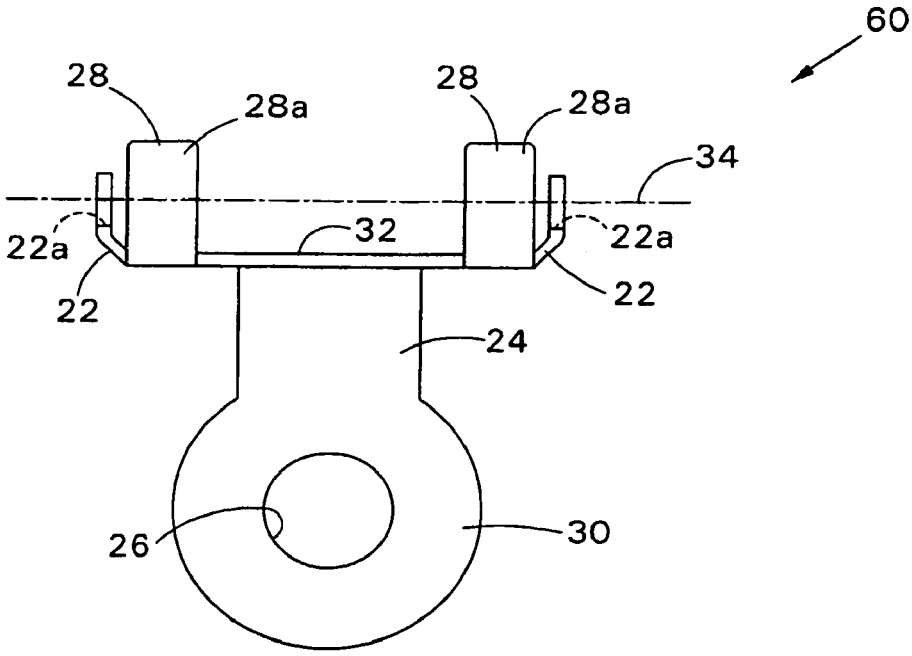
FIG. 10 is a side view of still another embodiment of a grounding connector in the present invention.

Referring to FIG. 10, grounding connector 60 is still another grounding connector in the present invention which differs from grounding connector 18 in that the contact members 22 can be bent at a right angle relative to the base 32 in a single bend. This can position the contact members 22 close to the crimping structures 28 and simplify the manufacturing process since less bending is required. Although the securement portion 30 is shown with a hole 26 for accepting a stud such as a plastic fastener 20, the securement portion 30 can have locking mechanisms, including those seen in FIGS. 7–9.

Figure 11:
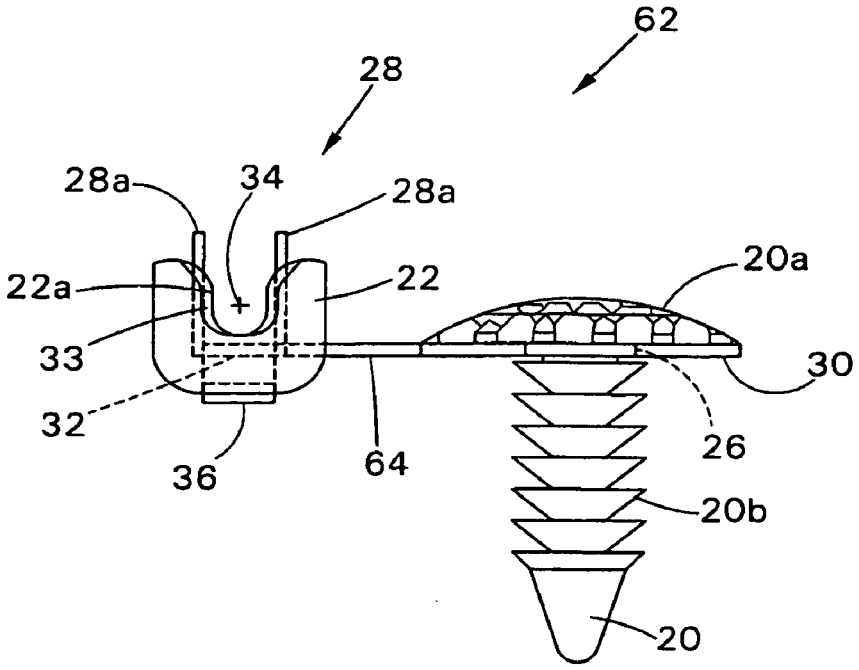
FIG. 11 is an end view of another embodiment of a grounding connector in the present invention.

Referring to FIG. 11, grounding connector 62 is another grounding connector in the present invention which differs from grounding connector 18 in that the grounding arm 64 is not bent relative to the base 32, but can lie along a common plane with the base 32. In one embodiment, the opening 26 within securement portion 30 can be located about 0.26 inches away from the cable axis 34. However, it is understood that this distance can vary. The fastener 20 in some embodiments can be a 6 mm rosebud. Although grounding connector 62 is shown having a fastener 20 such as a rosebud push stud, alternatively, other locking mechanisms can be employed, for example, those shown in FIGS. 7–9. Furthermore, the contact members 22 can be bent in the manner similar to that shown in FIG. 10.

Figure 12:
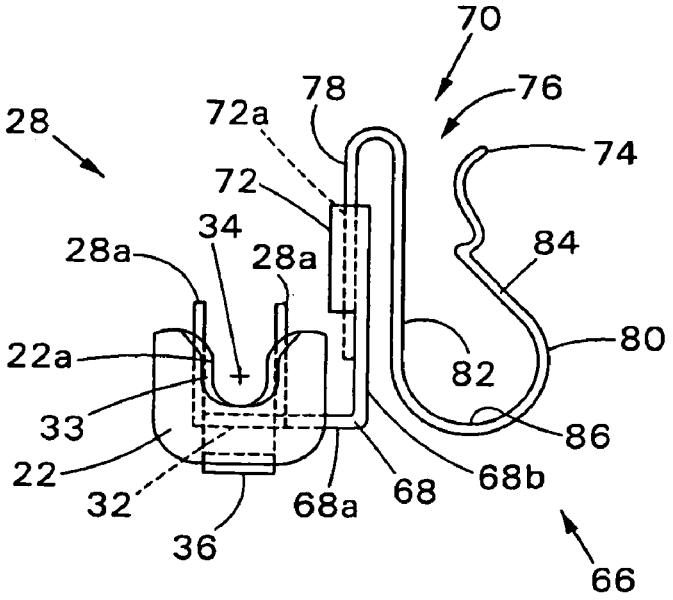
FIG. 12 is an end view of another embodiment of a grounding connector in the present invention.

Referring to FIG. 12, grounding connector 70 is another grounding connector in the present invention which differs from grounding connector 18 in that the grounding arm 66 includes a conductive resilient clip portion 80 for mechanically and electrically securing the grounding connector 70 to the grounding surface 25 by resilient clipping to the grounding surface 25. The clip portion 80 has an entranceway 76 between two generally opposed resilient legs 82 and 84, which are connected together by an intermediate portion 86. Leg 84 can be bent slightly towards leg 82 and can have a tip 74 that is curved outwardly to allow smooth entry of the grounding surface 25 into the space between legs 82 and 84. Resilient spreading apart of the legs 82 and 84 on opposed surfaces of the grounding surface 25 can allow the clip portion 80 to grip or clamp the grounding surface 25 with enough force to provide an electrical connection. The grounding arm 66 can include an arm portion 68 extending from the base 32 to which the clip portion 80 is secured. In the embodiment depicted, the arm portion 68 has a proximal portion 68*a* extending along the plane of base 32 and a distal portion 68*b* bent at an angle, for example, a right angle. Clip portion 80 has a portion 78 that is bent from leg 82 for securement to the distal portion 68*b* of arm portion 68. The distal portion 68*b* has a pair of crimping tabs 72 which are crimped over the portion 78 of leg 82 to secure the clip portion 80 to the arm portion 68. The portion 78 of leg 82 is held within a channel 72*a* formed by the crimping tabs 72. In one embodiment, the clip portion 80 can be a steel clip, but alternatively, can be made of other suitable metals or conductive materials, and can have varying dimensions. The clip portion 80, in some embodiments, can be considered both a fastener and part of the grounding member or arm.

In other embodiments, the clip portion 80 can be crimped to the base 32, welded, brazed, or soldered to the arm portion 68 or the base 32, or can be integrally formed with the base 32. In addition, the clip portion 80 can be of other suitable configurations or be in other orientations depending upon the situation at hand. Furthermore, the contact members 22 can be bent in the manner similar to that shown in FIG. 10.

While this invention has been particularly shown and described with references to particular embodiments thereof, it will be understood by those skilled in the art that various changes in form and details may be made therein without departing from the scope of the invention encompassed by the appended claims.

For example, although the grounding connectors shown in the figures have two securement structures 28 with two contact members 22, it is understood that some embodiments of grounding connectors can include only one of each. Having two of each, as shown in the figures, can provide redundancy in the event that there is failure to make an electrical connection at one end of the grounding connector. Although the grounding connectors of the present invention have been described for grounding the outer conductor of coaxial cables, it is understood that the grounding connectors can be used for grounding other types of cables, such as cables with a single conductor. In addition, although the grounding connectors of the present invention are commonly formed from sheet metal, alternatively, the grounding connectors can be formed by molding or machining conductive material. Furthermore, in some embodiments of cable assembly 10, other grounding connectors can be employed. Finally, the fasteners, locking mechanisms and clip portions can be oriented in opposite or intermediate orientations to those shown, depending upon the situation at hand.

What is claimed is:

1. A grounding connector for a cable formed of electrically conductive sheet material, the cable having an outer layer of insulation, the connector comprising:

a base;

a first crimping structure extending from the base for crimping to the cable and securing the cable relative to the base along a cable axis;

a second crimping structure extending from the base for crimping to the cable and securing the cable relative to the base along the cable axis;

a first contact member extending from the base laterally adjacent to the first crimping structure, the first contact member having a narrowing first cable slot for receiving die cable to engage and form electrical contact with the cable when the first crimping structure is crimped to the cable, the first cable slot capable of receiving the cable and cutting through the outer layer of insulation for forming electrical contact with the cable, the first cable slot having a bevelled cutting edge and terminating in a radiused slot end; and a second contact member extending from the base laterally adjacent to the second crimping structure, the second contact member having a narrowing second cable slot for receiving the cable to engage and form electrical contact with the cable when the second crimping structure is crimped to the cable, the second cable slot capable of cutting through the outer layer of insulation for forming electrical contact with the cable, the second cable slot having a bevelled cutting edge and terminating in a radiused slot end, the first and second contact members being bent from the base away from the cable axis, then back towards and across the cable axis for aligning the cable axis with desired portions of the first and second cable slots.

2. The connector of claim 1 in which the first and second crimping structures each include a pair of crimping tabs.

3. The connector of claim 1 in which the first and second cable slots are sized for forming electrical contact with an outer conductor of a coaxial cable.

4. The connector of claim 1 further comprising a grounding member extending from the base for electrical connection to a grounding surface.

5. The connector of claim 4 in which the grounding member includes a fastener portion for securement to the grounding surface.

6. The connector of claim 5 in which the connector provides grounding for the cable and serves as a retaining clip.

7. The connector of claim 5 in which the grounding member includes an opening through which a stud can be inserted for securing the grounding member to the grounding surface.

8. The connector of claim 6 further comprising a plastic push stud extending through the opening in the grounding member, the plastic push stud for securing the grounding member to the grounding surface.

9. The connector of claim 6 in which the opening in the grounding member includes self locking features for locking to a grounding stud protruding from the grounding surface.

10. The connector of claim 5 in which the grounding member includes a resilient conductive clip portion for resiliently clipping to the grounding surface with opposed legs.

11. The connector of claim 10 in which the conductive clip portion is a separate piece that is secured to the connector.

12. A grounding connector for a coaxial cable formed of electrically conductive sheet material, the coaxial cable having an outer layer of insulation and inner and outer conductors, the connector comprising:

a base;

first and second crimping structures extending front the base for crimping to the cable and securing the cable relative to the base along a cable axis, the first and second crimping structures each including a pair of crimping tabs;

first and second contact members extending from the base, the first contact member being laterally adjacent to the first crimping structure and the second contact member being laterally adjacent to the second crimping structure, the first and second contact members having respective narrowing first and second cable slots for receiving the cable to engage and form electrical contact with the cable when the first and second crimping structures are crimped to the cable, the first and second cable slots capable of cutting through the layer of insulation for forming electrical contact with the outer conductor of the cable, the first and second cable slots having bevelled cutting edges and terminating in radiused slot ends, the first and second contact members being bent from the base away from the cable axis, then back towards and across the cable axis for aligning the cable axis with desired portions of the first and second cable slots; and a grounding member extending front the base for electrical connection to a grounding surface, the grounding member including an opening through which a stud can be inserted for securing the grounding member to the grounding surface, whereby the connector provides grounding for the cable and serves as a retaining clip.

13. The connector of claim 12 further comprising a plastic push stud extending through the opening in the grounding member, the plastic push stud for securing the grounding member to the grounding surface.

14. The connector of claim 12 in which the connector provides grounding for the cable and serves as a retaining clip.

15. A method of forming a grounding connector for a cable from electrically conductive sheet material, the cable having an outer layer of insulation, the method comprising:

forming a base;

extending a first crimping structure front the base for crimping to the cable and securing the cable relative to the base along a cable axis;

extending a second crimping structure from the base for crimping to the cable and securing the cable relative to the base along the cable axis;

extending a first contact member from the base laterally adjacent to the first crimping structure, the first contact member having a narrowing first cable slot for receiving the cable to engage and form electrical contact with the cable when the first crimping structure is crimped to the cable, the first cable slot being capable of receiving the cable and cutting through the outer layer of insulation for forming electrical contact with the cable, the first cable slot having a bevelled cutting edge and terminating in a radiused slot end; and extending a second contact member from the base laterally adjacent to the second crimping structure, the second contact member having a narrowing second cable slot for receiving the cable to engage and form electrical contact with the cable when the second crimping structure is crimped to the cable, the second cable slot capable of cutting through the outer layer of insulation for forming electrical contact with the cable, the second cable slot having a bevelled cutting edge and terminating in a radiused slot end, the first and second contact members being bent from the base away from the cable axis, then back towards and across the cable axis for aligning the cable axis wit desired portions of the first and second cable slots.

16. The method of claim 15 further comprising forming the first and second crimping structures each with a pair of crimping tabs.

17. The method of claim 15 further comprising sizing the first and second cable slots for forming electrical contact with an outer conductor of a coaxial cable.

18. The method of claim 15 further comprising extending a grounding member from the base for electrical connection to a grounding surface.

19. The method of claim 18 in which the grounding member includes a fastener portion for securement to the grounding surface.

20. The method of claim 19 further comprising forming an opening through which a stud can be inserted for securing the grounding member to the grounding surface.

21. The method of claim 20 further comprising extending a plastic push stud through the opening in the grounding member, the plastic push stud for securing the grounding member to the grounding surface.

22. The method of claim 20 further comprising forming the opening in the grounding member to include self locking features for locking to a grounding stud protruding from the grounding surface.

23. The method at claim 19 further comprising providing the grounding member with a resilient conductive clip portion for resiliently clipping to the grounding surface with opposed legs.

24. The method of claim 23 in which the conductive clip portion is a separate piece, the method further comprising securing the conductive clip portion to the connector.

* * * * *

UNITED STATES PATENT AND TRADEMARK OFFICE

CERTIFICATE OF CORRECTION

PATENT NO. : 7,182,625 B2
APPLICATION NO. : 11/004351
DATED : February 27, 2007
INVENTOR(S) : Manuel H. Machado and Jonathan D. Young It is certified that error appears in the above-identified patent and that said Letters Patent is hereby corrected as shown below:

On the title page, item [75] delete the following:
"Inventors: Manuel H Machado" and insert the following:
--Inventors: Manuel H. Machado--

Column 9
Claim 1, line 21, please delete "die cable to engage" and insert --the cable to engage--;

Column 10
Claim 12, line 13, please delete "front" and insert --from--

Column 10
Claim 15, line 54, please delete "front" and insert --from--;

Column 11
Claim 15, line 15, please delete "cable axis wit desired" and insert --cable axis with desired--

Signed and Sealed this

Nineteenth Day of June, 2007

JON W. DUDAS
*Director of the United States Patent and Trademark Office*